US005429342A

United States Patent [19]

Pfyl et al.

[11] Patent Number: 5,429,342

[45] Date of Patent: Jul. 4, 1995

[54] SLIDE GATE NOZZLE INCLUDING SEQUENTIALLY REPLACEABLE REFRACTORY SLIDING PLATES AND REFRACTORY PLATE ASSEMBLY EMPLOYABLE THEREIN

[75] Inventors: Anton Pfyl, Affoltern a.A.; Werner Keller, Steinhausen; Walter Toaldo, Zug; Werner Plattner, Hünenberg, all of Switzerland

[73] Assignee: Stopinc Aktiengesellschaft, Baar, Switzerland

[21] Appl. No.: 155,854

[22] Filed: Nov. 23, 1993

[30] Foreign Application Priority Data

Nov. 25, 1992 [CH] Switzerland ..... 03611/92

[51] Int. Cl.[6] ..... B22D 41/28

[52] U.S. Cl. ..... 266/236; 222/600

[58] Field of Search ..... 266/236; 222/600, 597

[56] References Cited

U.S. PATENT DOCUMENTS 4,260,081 4/1981 Detalle et al. ..... 222/600

4,520,860 6/1985 Haissig et al. ..... 222/600

FOREIGN PATENT DOCUMENTS 647702 2/1985 Switzerland .

*Primary Examiner*—Scott Kastler

*Attorney, Agent, or Firm*—Wenderoth, Lind & Ponack

[57] ABSTRACT

A slide gate nozzle for controlling the discharge of molten metal from a spout of a converter vessel includes a refractory bottom plate to be positioned stationarily with a discharge opening thereof aligned with an opening of the spout. A refractory slide valve plate is mounted for sliding movement relative to the bottom plate such that a discharge opening of the slide valve plate is brought into and out of alignment with the discharge opening of the bottom plate. A plurality of refractory shut-off plates are positioned sealingly between the bottom plate and the slide valve plate. A coupling mechanism is operably mounted to the shut-off plates to sequentially connect the shut-off plates rigidly either to the bottom plate or to the slide valve plate. As a result, the shut-off plates may be used sequentially to replace the slide valve plate.

35 Claims, 4 Drawing Sheets

SLIDE GATE NOZZLE INCLUDING SEQUENTIALLY REPLACEABLE REFRACTORY SLIDING PLATES AND REFRACTORY PLATE ASSEMBLY EMPLOYABLE THEREIN

BACKGROUND OF THE INVENTION

The present invention relates to a sliding closure unit or slide gate or slide gate nozzle, particularly for use in controlling the discharge of molten metal from a spout of a converter vessel. The present invention particularly is related to such a slide gate nozzle that includes a stationary refractory bottom plate to be positioned stationarily with a discharge opening thereof aligned with an opening of the spout of the converter vessel and a movable refractory slide valve plate mounted for sliding movement relative to the bottom plate such that a discharge opening of the slide valve plate may be brought into and out of alignment with the discharge opening of the bottom plate. The slide valve plate seals against the bottom plate and enables controlled discharge of the molten metal from the spout of the converter vessel. The present invention also relates to a refractory plate assembly employable in such a slide gate nozzle.

A slide gate nozzle of the above described type is disclosed in Swiss CH-PS 647,702. Such known slide gate nozzle includes a refractory bottom plate adjoining directly a runner mortared into the spout of the converter vessel and a refractory slide valve plate which sealingly slides on the bottom plate, and a refractory discharge sleeve mounted on and movable with the slide valve plate. Otherwise, the construction of such known slide gate nozzle corresponds substantially to universally known two-plate slide gates or sliding closure units.

During operation of a converter vessel employing such known slide gate nozzle, the following problems inherently occur. Thus, the diameter of a converter vessel taphole ranges normally from 100 to 200 mm. Therefore, when the slide gate nozzle is installed, the slide gate nozzle itself and also the slide valve plate to be installed therein must be dimensioned correspondingly large. Manipulating such members, for example to change worn plates, can be done only with great difficulty. Particularly, due to the solid and large size construction of the members of the slide gate nozzle, exchange of worn plates normally can be carried out only with the aid of large cranes. A tapping runner of the spout of the converter vessel usually comprises several refractory sleeves, i.e. so-called tapping bricks, that have a service life equal to the time required to achieve from 70 to 130 charges or tappings of the converter vessel. This service life is average according to the current state of the art wherein it is possible to achieve up to 35 charges or tappings per day. Thus, the converter vessel is maintained in service virtually without interruption until it is necessary to replace worn or consumed tapping bricks. However, according to the current state of the art, the service life of the refractory bottom plate and the refractory slide valve plate of the slide gate nozzle is equal only to a maximum of 30 charges or tappings. Therefore, the bottom plate and the slide valve plate have to be replaced a number of times during one intended continuous operation of the converter vessel of up to 130 charges. This means that in fact the operation of the converter vessel is not continuous and uninterrupted, but rather must be interrupted multiple times to replace worn bottom and slide valve plates. This results in unavoidable delays in the use of the converter vessel. Moreover, suitably trained personnel to service the slide gate nozzle must be provided for such replacement operations. Therefore, every day practice has shown that use of such known slide gate nozzle on converter vessels correspondingly is quite cost intensive and even can interfere with the required operational sequence of the converter vessel. Therefore, it in fact has not been practically possible to employ such known slide gate nozzle for controlling the discharge of molten metal from a spout of a converter vessel.

SUMMARY OF THE INVENTION

With the above discussion in mind, it is an object of the present invention to provide an improved slide gate nozzle whereby it is possible to overcome the above and other prior art disadvantages.

It is a further object of the present invention to provide such an improved slide gate nozzle uniquely suitable for operation in controlling the discharge of molten metal from a spout of a converter vessel.

It is a yet further object of the present invention to provide such an improved slide gate nozzle capable of uninterrupted operation for a length of time at least equal to the time required for approximately 100 tappings, preferably at least 135 tappings, of the converter vessel.

It is an even further object of the present invention to provide such an improved slide gate nozzle whereby worn plates may be replaced as necessary without interruption of operation of the converter vessel.

It is a yet still further object of the present invention to provide an improved refractory plate assembly for use in such improved slide gate nozzle.

The above objects are achieved in accordance with the present invention by sealingly positioning between the bottom plate and slide valve plate at least one additional refractory plate, hereinafter referred to as shut-off plate, and preferably a plurality of such additional shut-off plates that essentially can be manipulated during the operation of the converter vessel to replace the function of the slide valve plate. More particularly, the at least one additional refractory shut-off plate is positioned sealingly between the bottom plate and the slide valve plate and is mounted to be selectively attached rigidly either to the bottom plate or to the slide valve plate, in either case with the discharge opening of the at least one shut-off plate being aligned with the discharge opening of the plate to which the at least one shut-off plate is rigidly attached. When the shut-off plate is rigidly attached to the bottom plate, then the slide valve plate sealingly slides relative to such shut-off plate. When the shut-off plate is rigidly attached to the slide valve plate, then such shut-off plate slides sealingly, with the slide valve plate, relative to the bottom plate.

Preferably there are provided a sufficient number of additional shut-off plates so that the total service life of the slide valve plate and the additional shut-off plates corresponds to the service life of the refractory sleeves employed to form the spout or taphole of the converter vessel.

By the provision of these features of the present invention, it is possible to employ a slide gate nozzle and the advantages thereof to control the discharge of molten metal from a spout of a converter vessel, while avoiding interruption of the substantially continuous operation of the converter vessel until it is necessary to shut down the converter vessel to replace the refractory sleeves of the taphole thereof. This is possible in accordance with the present invention by the provision of easily operable and manipulatable structure to sequentially exchange worn plates. This also is achieved without substantial additional expense.

In accordance with a preferable manner of operation of the improved slide gate nozzle of the present invention, the additional shut-off plates first would be rigidly attached to the bottom plate with the discharge openings of the shut-off plates all aligned with the discharge opening of the bottom plate. At this time, the slide valve plate is moved in a conventional manner to control discharge of molten metal from the converter vessel. At such time as the slide valve plate becomes worn due to repeated opening and closing operations, that shut-off plate closest to the slide valve plate is attached to the slide valve plate and thereafter is moved with the slide valve plate, the other shut-off plates remaining attached to the bottom plate and being positioned immovably. At such time, the worn slide valve plate actually is protected from further substantial wear by the shut-off plate attached thereto, and such shut-off plate then assumes the function of the slide valve plate and is subjected to opening and closing stresses. Following wear of this shut-off plate, the next adjacent shut-off plate is attached to the first shut-off plate and to the slide valve plate and subsequently is moved therewith. This procedure is repeated sequentially until all of the shut-off plates are worn. It is not until then that it becomes necessary to interrupt operation of the converter vessel to open the slide gate nozzle and to install new plates. In this manner, the slide gate nozzle can be maintained operably attached to the converter vessel without maintenance for a significantly longer period of time than has been possible with known slide gate nozzles. To avoid interruption of operation of a conventional converter vessel, preferably at least three additional shut-off plates are provided such that it is possible to achieve a continuous service life of the slide gate nozzle of approximately 100 or more tappings of the converter vessel.

A coupling mechanism is provided to couple each shutoff plate either to the bottom plate or the slide valve plate in the manner discussed above, and a number of preferred embodiments of such coupling mechanism are disclosed herein.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
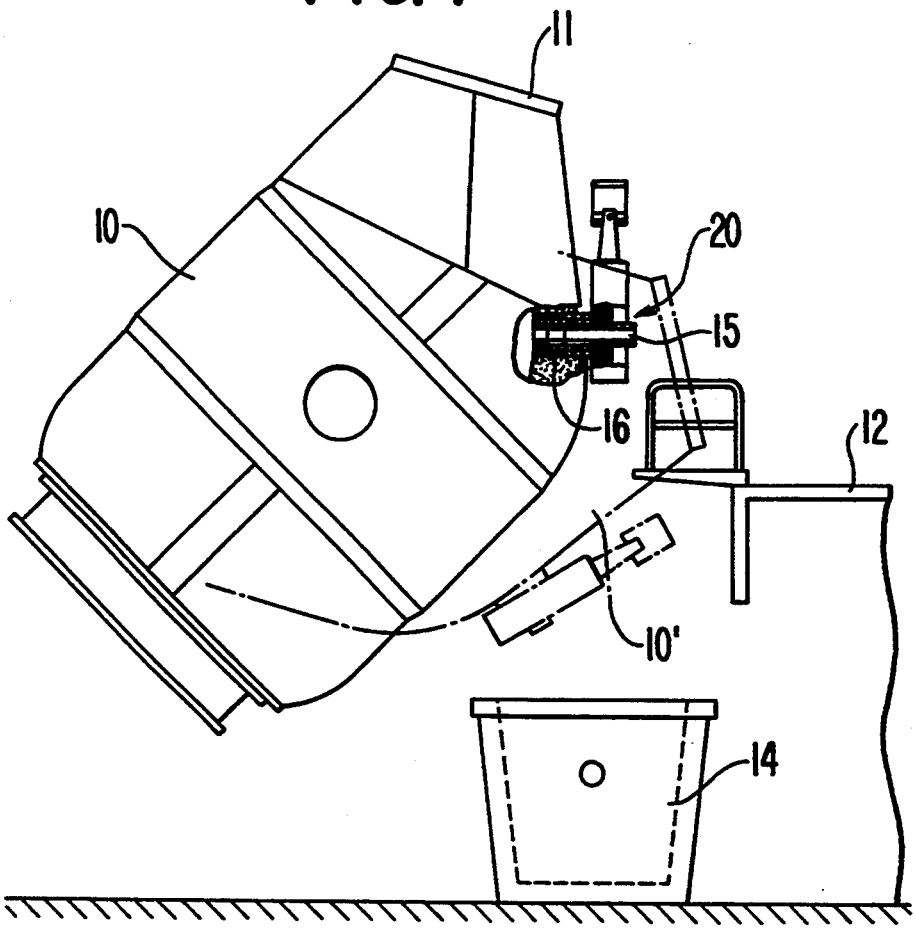
FIG. 1 is a schematic side view of a converter vessel having a spout equipped with an improved slide gate nozzle according to the present invention.

FIG. 1 schematically illustrates the basic construction and arrangement of a converter system including a tiltable converter vessel 10 and a platform 12. Converter vessel 10 has at the top thereof a large opening 11 and on a side thereof a spout 15 designed as a so-called taphole and through which molten metal, for example molten steel, is poured or discharged into a ladle 14 when the vessel 10 is swung into a tapping position 10' shown by dashed lines. The present invention is useful in such a converter system, but it is to be understood that the present invention is not limited specifically to use in such a converter system, and indeed the present invention could be applied to other known types of metallurgical vessels.

A slide gate nozzle 20 according to the present invention is mounted on the side of vessel 10, and when vessel 10 is in position 10', slide gate nozzle 20 is controllably opened so that molten steel may flow from vessel 10 into ladle 14. Normally, an early slag recognition detector is installed into tapping bricks 16 mortared into spout 15. When slag at the end of a tapping operation starts to flow at spout 15, such early slag recognition detector would detect such slag and, by means of an electronic evaluating unit would operate slide gate nozzle 20 to close in the shortest possible time, approximately one second, thereby preventing slag from flowing into ladle 14. Thereafter, the slag would be poured out through the opening 11 of the converter vessel 10.

As discussed above, it is intended that operation of the converter vessel be maintained in service uninterrupted substantially without exception for an extended period of time, for example about three days, such period depending ultimately on the life of tapping bricks 16. Therefore, practical operation of converter vessel 10 does not allow, or at least is greatly hindered, if during such period of time it is necessary to perform maintenance operations on the slide gate nozzle, such as replacing worn or spent refractory plates. The present invention avoids the necessity of such maintenance operation by improving the slide gate nozzle 20 to have the following configuration.

Figure 2:
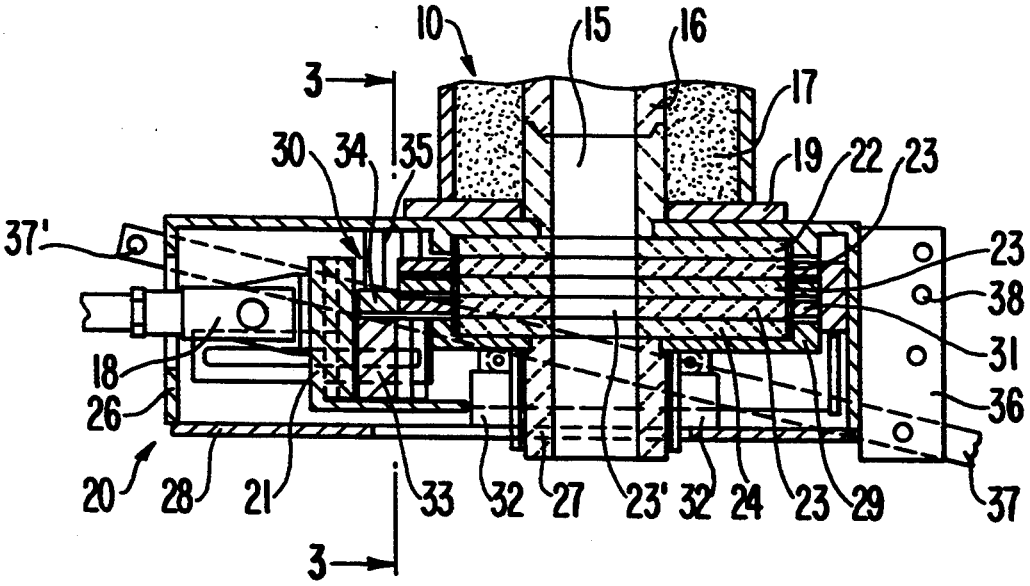
FIG. 2 is an enlarged longitudinal cross sectional view of an embodiment of a slide gate nozzle according to the invention.

As shown in FIG. 2, slide gate nozzle 20 is detachably mounted at the taphole of converter vessel 10. The taphole forms spout 15 defined by known refractory sleeves, i.e. so-called tapping bricks 16. Such tapping bricks 16 are well known and are, as is known, mortared into refractory lining 17 of vessel 10 enveloped by a steel shell 19. Slide gate nozzle 20 includes a housing frame 26 in which is mortared a conventional refractory bottom plate 22 sealingly adjoining the outermost tapping brick 16, such outermost brick being embedded and locked into position in plate 22. The slide gate nozzle furthermore includes a cover 28 closing an outer bottom of the housing frame 26. The slide gate nozzle further includes a slide frame 21 mounted for sliding movement within housing frame 26 by means of a drive rod 18 of a drive, not fully shown. A slide 29 is mounted in slide frame 21 and supports a mortared and embedded refractory slide valve plate 24. These elements in and of themselves are intended to be of any known and conventional structure.

In accordance with the present invention however, the slide gate nozzle 20 is improved to furthermore include at least one additional shut-off plate 23 sealingly positioned between plates 22 and 24. In the illustrated arrangement of FIG. 2, three additional refractory shut-off plates 23 are provided, each having therethrough an opening 23' to be aligned selectively, in manners to be discussed in more detail below, either with the discharge opening through plate 22 or with the discharge opening through plate 24. In the open position of the slide gate nozzle illustrated in FIG. 2, the discharge openings of plates 22, 23, 24 all are in alignment with the taphole defined by tapping bricks 16 and with a subsequent replaceable refractory sleeve 27 that is detachably mounted on or in slide 29 in a known manner. The illustrated slide gate nozzle 20 also includes four spring assemblies 32 mounted symmetrically to spout 15 and braced at cover 28 to press slide 29 with sufficient contact force to press all of plates 22, 23, 24 sealingly against each other, thus preventing molten metal from flowing therebetween.

Each shut-off plate 23 is rigidly attachable either to the bottom plate 22 or to the slide valve plate 24. Particularly, as pointed out above, it is contemplated that such attachments sequentially occur to extend the uninterrupted service life of the slide gate nozzle 20. Such attachment is achieved by a coupling mechanism, various embodiments of which are illustrated and which now will be discussed.

Figure 3:
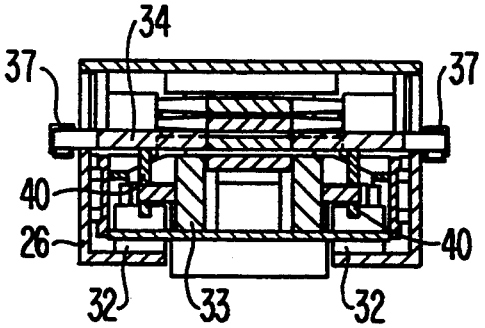
FIG. 3 is a sectional view taken along line 3—3 of FIG. 2.
Figure 4:
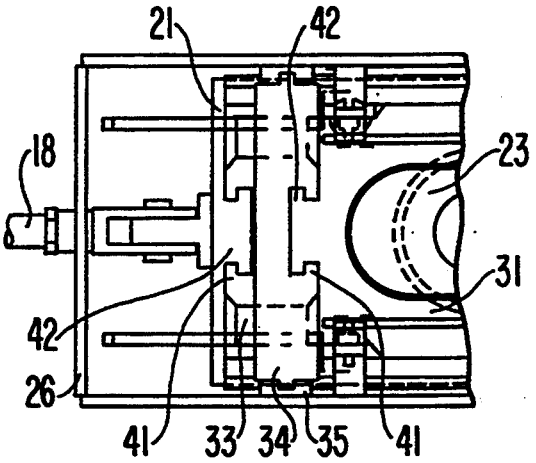
FIG. 4 is a partial plan view of the embodiment of FIG. 2.

FIGS. 2–4 illustrate a first embodiment of a coupling mechanism 30 that is provided on the drive side of slide frame 21. By means of coupling mechanism 30, shut-off plates 23 are rigidly attached with the slide frame 21 and thus with slide valve plate 24 or are attached rigidly to housing frame 29 and thereby to bottom plate 22. More specifically, coupling mechanism 30 includes a first guide or connecting member 33 mounted in slide frame 21 to be movable longitudinally therewith in a first direction, i.e. left and right as viewed in FIG. 2. Member 33 is mounted in slide frame 21 also to be relatively movable with respect thereto in a second direction, i.e. vertically in FIG. 2, transverse to the first direction. The coupling mechanism 30 further includes a second blocking or connection member 34 mounted in housing frame 26 to be movable relative thereto in the second direction, i.e. vertically as viewed in FIG. 2. Specifically, member 34 is guided for such movement in sliding rails 35 provided in housing frame 26. An adjusting device is coupled to second connection member 34 to selectively adjust the position thereof in the second direction, i.e. vertically in FIG. 2, with respect to housing frame 26. Such adjusting device includes a pair of levers 37 positioned on opposite sides of housing frame 26 and pivotable about an axis 37'. Levers 37 are coupled to member 34 such that pivoting of levers 37 about axis 37' raises and lowers member 34 with respect to housing frame 26. A positioning plate 36 is provided to define limiting positions of such pivoting movement, for example by rods or pins defining four such possible positions 38 in the illustrated embodiment. As shown in FIGS. 3 and 4, levers 37 are coupled to member 34 which in turn is coupled to member 33, for example by levers or brackets 40 that allow relative displacement between members 33, 34 in the first direction, i.e. to the right and left as viewed in FIG. 2. Thus, pivoting of levers 37 upwardly moves member 34 upwardly relative to housing 26. This also moves member 33 upwardly relative to frame 21, but allows movement of member 33 and slide frame 21 to the right and left as viewed in FIG. 2.

As shown in the drawings, each shut-off plate 23 is mounted in a respective support frame 31. Each support frame 31 has, as shown in FIG. 4, extending from an end thereof a projection 42 defining on opposite sides thereof vertical grooves. This projection and these grooves are complementary to grooves 41 formed in member 34. Thus, as member 34 is selectively moved upwardly or downwardly as viewed in FIG. 2, grooves 41 of member 34 sequentially complementarily fit over projection 42 of support frame 31 of a selected of the shut-off plates 23. By this action, as member 34 is moved vertically in FIG. 2, it becomes coupled sequentially to selected of the support frames 31 and thus the shut-off plates 23. This operation selectively rigidly attaches shut-off plates 23 to bottom plate 22 that is rigid with housing frame 26. As further will be apparent from FIG. 4 of the drawings, slide frame 21 has a vertically extending projection 42 defining at opposite sides thereof grooves, and first member 33 has therein a recess complementary to projection 42 and grooves thereof. This achieves relative guiding of the first member 33 relative to slide frame 21 in the second direction, i.e. vertically as viewed in FIG. 2. First member 33 also has therein another groove 41 aligned with groove 41 of member 34 shown in FIG. 4 and positioned downwardly therefrom as viewed in FIG. 2. This groove of first member 33 selectively engages the projections of support frames 31 in the same manner discussed above regarding engagement thereof by groove 41 in second member 34. As a result, as levers 37 are pivoted upwardly in FIG. 2, members 34 and 33 selectively are moved upwardly so that the recesses 41 thereof sequentially engage respective projections 42 of the support frames 31. In this manner it is possible to sequentially rigidly attach the support frames 31 and thereby the respective shut-off plates 23 with the slide frame 21/slide valve plate 24 and with the housing frame 26/bottom plate 22.

More particularly, in the lowermost position 38 of levers 37 shown in FIG. 2, member 33 couples only slide valve plate 24 with slide frame 21. On the other hand, member 34 couples rigidly with the support frame 31 of shut-off plate 23 located directly above slide valve plate 24. This coupling maintains the two shut-of plates 23 above the lowermost shut-off plate 23 uncoupled to member 34, but such two shut-off plates cannot move and are maintained in position. It is possible however to dimension member 34 such that it would couple over all three shut-off plates. This however would require sufficient free space at the top for adjustment into other positions. If at this time the levers 37 are pivoted upwardly to the next position 38, then members 34, 33 also are moved upwardly so that member 33 couples with the support frame 31 of the lowermost shut-off plate 23 which then is rigidly attached to slide valve plate 24 and slides therewith upon movement of slide frame 21. The member 34 on the other hand couples with the support frame 31 of the next upper shut-off plate 23 such that that plate and the plate 23 thereabove are rigidly attached to the bottom plate 22. By selective pivoting of the levers 37 it is possible to couple one more plate 23 to plate 24 and one less plate 23 to plate 22. Thereby, the service life of the slide gate nozzle 20 can be extended, and this can be adjusted by the provision of a lesser or greater number of additional shut-off plates 23.

Figure 5:
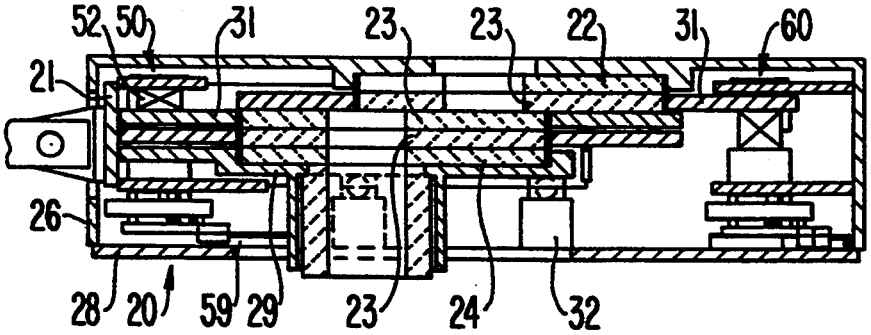
FIG. 5 is a longitudinal sectional view similar to FIG. 2 but of another embodiment of the present invention.
Figure 6:
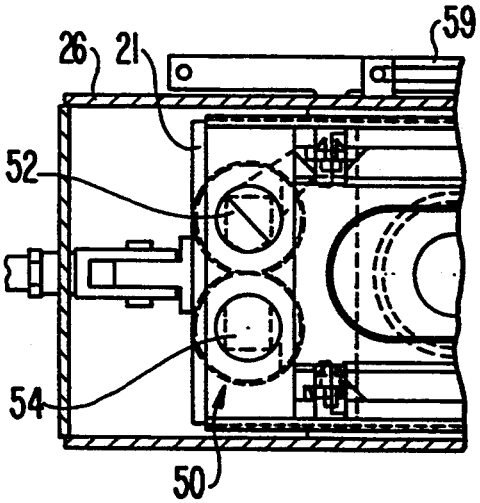
FIG. 6 is a partial top view of the embodiment of FIG. 5.
Figures 7A, 7B, 7C:
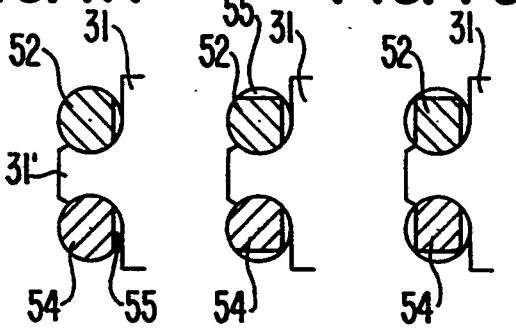
FIGS. 7A–7C are partial diagrammatic cross-sectional views of coupling structures employed in the embodiment of FIG. 5.

FIGS. 5–7 illustrate another embodiment of a coupling mechanism in accordance with the present invention. In this embodiment, the coupling mechanism includes two coupling assemblies 50, 60. Coupling assembly 50 enables selective coupling and uncoupling of support frames 31 and thus of respective shut-off plates 23 to slide frame 21 and thus to slide valve plate 24. On the other hand, second coupling assembly 60 achieves coupling and uncoupling of support frames 31 and thus of shut-off plates 23 to housing frame 59 and thus to bottom plate 22. Each coupling assembly includes at least one control pin, in the illustrated arrangement a pair of spaced parallel control pins 52, 54. FIG. 6 illustrates the control pins of coupling assembly 50, but the structure of coupling assembly 60 is similar. Control pins 52, 54 rotate in opposite directions about respective axes. Each support frame 31 has a nose or projection 31' extendable between the pair of control pins 52, 54. Projection 31' has on opposite sides thereof facing the control pins respective concave recesses. Each control pin has spaced axially along the length thereof respective coupling structures adapted to couple with and uncouple from the projections 31' of the respective shut-off plates 23. Particularly, depending on the rotary positions of the pins 52, 54, the respective coupling structures along such pins either couple with or uncouple from respective support frames 31. Each coupling structure spaced axially along the length of each control pin includes a specific combination of circumferentially extending configurations capable of achieving coupling or uncoupling. These circumferentially extending configurations include a first partial cylindrical configuration dimensioned to fit within the concave recess in the projection 31' of the support frame 31 of the respective shut-off plate 23 and a second configuration, for example formed by a recess 55 defined by a planar surface forming an axially extending chord of the circumference of the pin, that is dimensioned to not extend into the respective concave recess of the projection 31' of the support frame of the respective shut-off plate 23. FIGS. 7A–7C illustrate transverse sections taken along three positions of control pin 52, these three positions illustrating the structure of the circumferential configurations to achieve a particular sequence of coupling to respective of the support frames 31 and uncoupling therefrom. More particularly, with respect to the coupling structure illustrated in FIG. 7A, the cylindrical circumferential configuration of the two pins fits into the recesses in the projection 31'. If pin 52 is rotated clockwise and pin 54 is rotated counterclockwise by 90°, then recesses 55 will confront the recesses in projection 31' and there will not be coupling to the respective support frame 31. On the other hand, further rotation by 90° will result in coupling, and rotation even further by 90° still will result in coupling. On the other hand, in the coupling structure illustrated in FIG. 7B, coupling occurs, uncoupling occurs at rotation by 90°, further uncoupling occurs at a further 90° rotation, and coupling occurs at a yet further 90° rotation. Finally, in the coupling structure shown in FIG. 7C, coupling occurs only in the illustrated position. Rotation by three 90° increments always positions recesses 55 confronting the recesses in the projection 31', with the result that uncoupling occurs. In all instances, it is contemplated that the coupling structures on the control pins of the opposite coupling assembly 60 will have an inverse construction. In other words, when the coupling structures of coupling assembly 50 achieve coupling to a particular support frame 31, the corresponding coupling structures of the opposite coupling assembly 60 will achieve uncoupling for the same support frame. Thus, in the relationship shown in FIG. 5, only the uppermost shut-off plate 23 is fixedly attached to bottom plate 22. The other two shut-off plates 23 are rigidly attached to the slide valve plate 24. In the illustrated arrangement, there are three shut-off plates 23, and thus it is contemplated that the control pins are rotatable in 90° increments. A different number of shut-off plates could be provided, such that the incremental rotation of the control pins then would be different. Whatever the number of shut-off plates, the circumference of each control pin includes a whole number, equal to such number of shut-off plates, of equal angularly off-set portions. The circumferential length of the first coupling configuration of each pin equals a whole number of such portions, and the circumferential extent of each second uncoupling configuration equals one such portion. More particularly, in FIG. 7A, there are four equal angularly offset circumferential portions. The circumferential length of the coupling configuration equals three such portions, and the circumferential extent of each uncoupling configuration 55 equals one such portion. The number of portions would be different with a different number of shut-off plates and a different number of incremental rotations of the control pins. The rotation of the control pins is synchronous such that coupling and uncoupling of each of the support frames 31 occurs in unison and automatically. Thereby, there is provided an arrangement to easily provide coordinated coupling and uncoupling during changeover, for example from slide valve plate 24 to the next adjacent shut-off plate 23, and then from such shut-off plate 23 to the next shut-off plate 23, and so forth. Although this embodiment illustrates each coupling assembly as including two parallel control pins, in principle it would be possible to provide only a single control pin. However, such an arrangement would provide greater unilateral forces to be produced on a respective support frame. By the use of two control pins, such forces are canceled since there is employed a clamping action by such two control pins. In the arrangement shown in FIGS. 7A–7C, all three shut-off plates 23 are rigidly attached to slide valve plate 24. If pin 52 is rotated clockwise by 90° and pin 54 is rotated counterclockwise by 90°, then all three shut-off plates 23 are uncoupled from slide valve plate 24. If rotation occurs by another 90° increment, then only the shut-off plate 23 associated with FIG. 7A is coupled to slide valve plate 24. If rotation occurs by another 90° increment of rotation, then the shut-off plates associated with FIGS. 7A and 7B are coupled to slide valve plate 24. It will be apparent that the coupling and uncoupling of each shut-off plate 23 can be controlled by modification of the configurations of the coupling structures.

Figure 8:
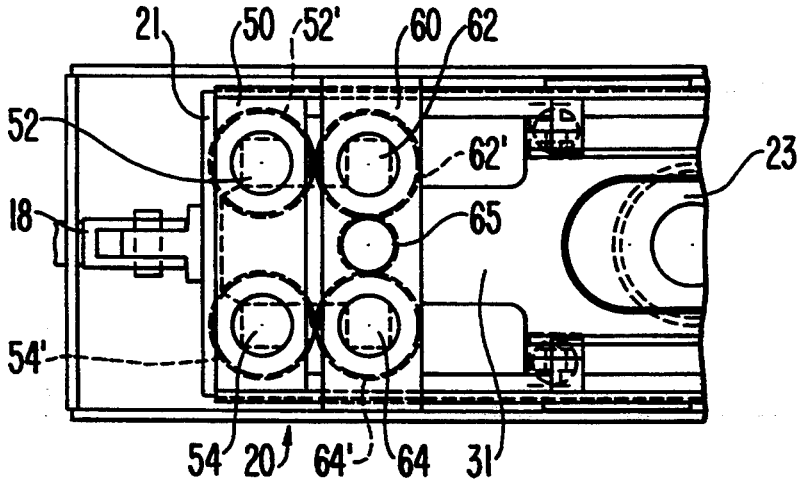
FIG. 8 is a view similar to FIG. 6 but of a modification thereof.

FIG. 8 illustrates an embodiment of the coupling mechanism intended to be the same as that of the embodiment of FIGS. 5–7, with the exception that both coupling assemblies 50, 60 are arranged on the same side of the assembly, i.e. on the side thereof at drive rod 18. This arrangement has the advantage that the control pins 52, 54 and 62, 64 of the two coupling assemblies 50, 60 can be rotationally connected together in synchronization. This can be achieved by way of respective gear wheels 52', 54', 62', 64' that are concentric with the respective control pins, and a pinion 65, for example in driving engagement with gear wheels 62', 64'. Otherwise, this embodiment corresponds to the embodiment of FIGS. 5–7.

Figure 9:
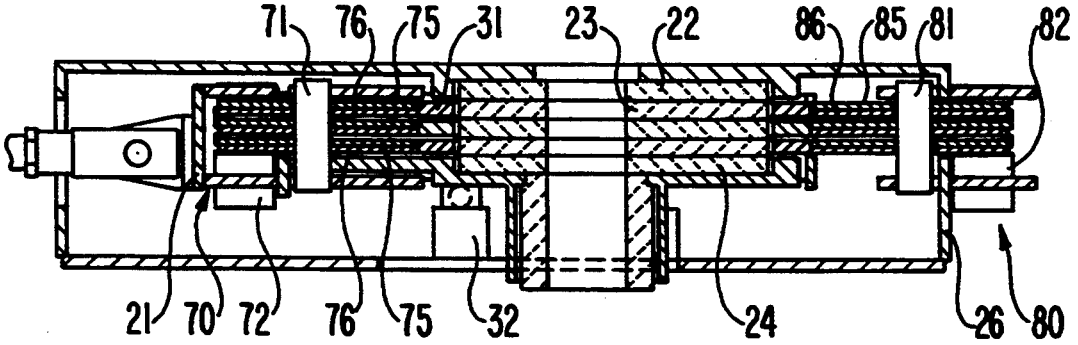
FIG. 9 is a longitudinal cross sectional view similar to FIG. 5 but of a further embodiment of the present invention.
Figure 10:
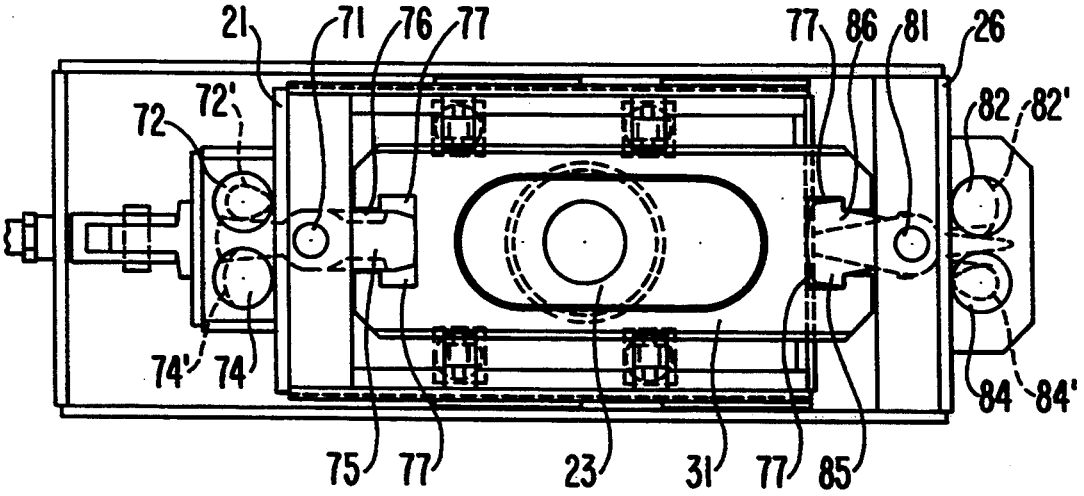
FIG. 10 is a top view of the embodiment of FIG. 9.

In the embodiment of FIGS. 9 and 10, the slide gate nozzle is the same as that of the embodiment of FIGS. 5–7, with the exception of the coupling structures actuated by rotation of respective control pins 72, 74 and 82, 84. In this embodiment, each end of each support frame 31 has therein a recessed opening defining opposite recesses 77. The coupling structures include, at positions spaced axially along the control pins, at least one lever, and in the illustrated embodiment lever pairs 75, 76 and 85, 86. First ends of the respective lever pairs are positioned between respective control pins 72, 74 and 82, 84. These lever ends are acted on by respective cam surfaces 72', 74' and 82', 84' of the respective control pins. At opposite ends of the lever pairs are respective hooks. Upon rotation of the respective control pin pairs 72, 74 and 82, 84 the cam surfaces thereof cause the lever pairs, that may be pivotable about respective axes 71, 81, to move toward and away from each other. When the second ends of each lever pair move toward each other, such ends may be moved into the openings in the support frames. When the second ends of the lever pairs then are moved away from each other, the hooks catch in respective recesses 77, thus achieving coupling to the respective support frame. When coupling of a given support frame is achieved at one end thereof, the opposite end thereof is uncoupled with the second ends of the respective lever pairs thereof moved toward each other such that uncoupling occurs. There are provided lever pairs at each end of each support frame, and the axially spaced cam surfaces are configured to achieve sequential coupling and uncoupling movement on the respective lever pairs. This embodiment achieves sequentially controlled coupling and uncoupling of opposite ends of each support frame 31 just like the embodiment of FIG. 5.

Figure 11:
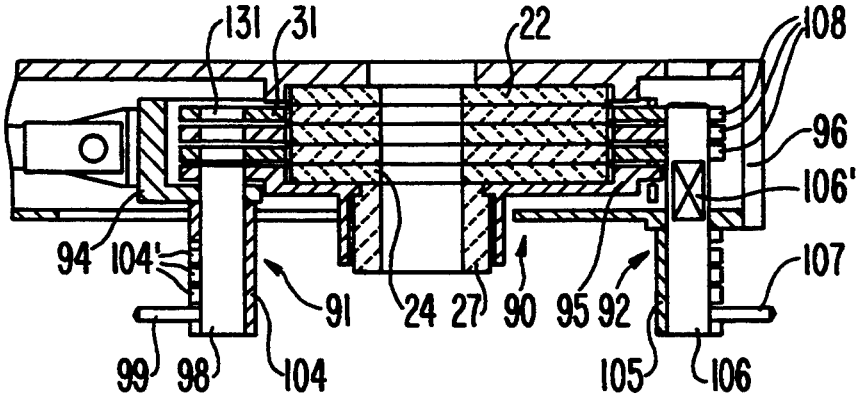
FIG. 11 is a longitudinal cross-sectional view similar to FIG. 5, but of a yet further embodiment of the present invention.
Figure 12:
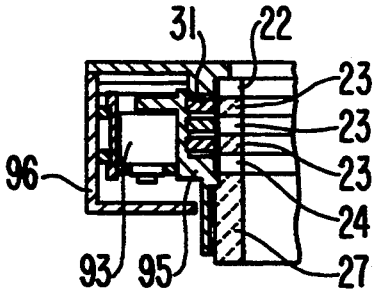
FIG. 12 is a partial transverse cross-sectional view of the embodiment of FIG. 11.
Figure 13:
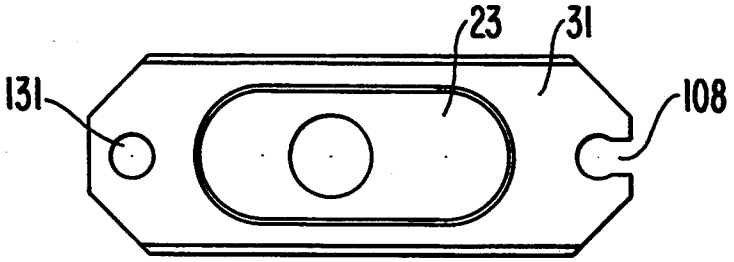
FIG. 13 is a top view of a shut-off plate and support frame employed in the embodiment of FIG. 11.

The embodiment of FIGS. 11–13 provides that the coupling mechanism also includes two coupling assemblies 91, 92. Coupling assembly 91 achieves coupling or uncoupling of each support frame 31 with respect to slide frame 94 and thereby slide valve plate 24. On the other hand, coupling assembly 92 achieves coupling or uncoupling of each of the support frames 31 to housing frame 96 and thus bottom plate 22. Each coupling assembly 91, 92 includes a respective bearing bushing 104, 105 rigidly fixed to slide frame 94 and housing frame 96, respectively. Within each bushing or sleeve 104, 105 is positioned a respective driving pin 98, 106 having respective operating levers 99, 107. Through respective first ends of support frames 31 are bores 131. By operation of lever 99 it is possible to move pin 98 axially of bearing or sleeve 104 to plural respective positions 104'. In the position illustrated in FIG. 11, pin 98 does not extend into any of bores 131. Thus, none of frames 31 are coupled to slide frame 94. On the other hand, if pin 98 is moved upwardly as shown in FIG. 11 to the next position 104, the upper end of pin 98 extends into bore 131 of the lowermost support frame 31, thereby coupling such support frame and the respective shut-off plate 23 to slide frame 94. It will be apparent that further upward incremental movements of pin 98 will achieve sequential coupling of additional support frames and respective shut-off plates. On the other hand, opposite second ends of the support frames 31 have therein openings in the form of bores having reduced size slots opening thereinto. These openings 108 are shown particularly in FIG. 13. Pin 106 has a major thickness portion, for example a major diameter portion, that corresponds to the inner enlarged size bore of opening 108. On the other hand, pin 106 has a reduced thickness portion corresponding to the reduced size slot leading into the bore of opening 108. In the illustrated arrangement, the reduced size thickness portion of pin 106 is formed by a pair of recesses 106' on opposite sides of pin 106, and the height of each recess corresponds to the height dimension of the three support frames 31. In the position illustrated in FIG. 11, the upper end, i.e. major diameter portion, of pin 106 fits through the bores of the openings 108 of all of the support frames. Thus, all of the support frames are coupled to the housing frame 96, and all of the shut-off plates 23 are attached to bottom plate 22 and will not slide with slide valve plate 24. If pin 106 is moved upwardly by a distance equal to the thickness of the lowermost support frame 31, then such support frame is aligned with the uppermost portion of recesses 106', with the result that the lowermost support frame then is uncoupled from housing frame 96 can be moved with the slide frame 94 since the reduced size slot of opening 108 of that support frame will allow the support frame to move relative to pin 106. Sequential upward movement of pin 106 will achieve sequential uncoupling of further of the support frames 31. The action of movement of pins 98, 106 upwardly of course is coordinated, the result being that when one support frame is coupled at one end thereof the opposite end thereof is uncoupled.

The embodiment of FIGS. 11–13 includes a further distinction from the previous embodiments. Thus, in this embodiment spring elements 93 are arranged on opposite sides of a slide 95. Spring elements 93 are not braced on housing frame 96, but rather on slide frame 94. This arrangement has the advantage that the overall height of the slide gate nozzle can be maintained very low.

Figure 14:
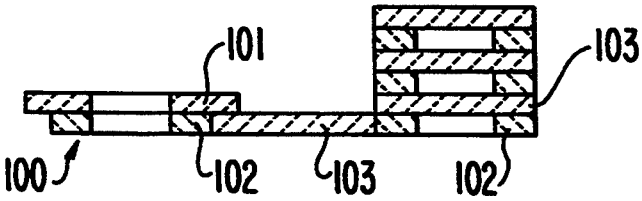
FIG. 14 is a schematic sectional view illustrating a principle of operation of an alternative concept encompassed within the scope of the present invention.

FIG. 14 illustrates schematically an alternative concept within the scope of the present invention. In this alternative concept, additional shut-off plates are not provided in a stacked arrangement between a bottom plate and a slide valve plate. Rather, a slide valve plate 102 of a refractory plate assembly 100 sealingly slides beneath a bottom plate 101. Additional shut-off plates 103 and slide valve plates 102 can be arranged on the side of the slide valve plate 102 that is positioned sealingly below bottom plate 101. Such additional plates can be advanced, for example by way of a casing or housing, when the slide valve plate 102 beneath bottom plate 101 becomes worn. It will be apparent that several stacked plates could just as well be advanced in a suitable and similar manner. By this alternative concept, the principle of the present invention similarly is achieved.

The present invention has been described with regard to a rectilinearly movable slide gate nozzle. In principle, a rotary slide gate nozzle with several plates could also be employed in accordance with the concept of the present invention.

In prior art converters, there are used in the spout thereof tapping bricks designed with openings which taper off in the direction of the exterior of the converter vessel. In the present invention, this feature can be utilized by providing the openings of the refractory plates that follow relatively the tapping bricks with relatively smaller diameter openings.

In the above described and illustrated embodiments, the coupling mechanisms are designed in such a manner that first only the slide valve plate 24 is moved, and then sequentially one after another of the additional shut-off plates are taken along with the slide valve plate. In principle, a reverse arrangement also is possible wherein first all of the shut-off plates could be moved with the slide valve plate, and then one after another of the shut-off plates sequentially could be removed from the slide valve plate and attached to the bottom plate. Even further, it is possible in accordance with the present invention to have any of the plurality of shut-off plates 23 moved individually regardless of a sequential progression of movement thereof.

Although the present invention has been described and illustrated with respect to preferred features thereof, it is to be understood that various modifications and changes may be made to the specifically described and illustrated arrangements without departing from the spirit and scope of the present invention.

We claim:

1. A slide gate nozzle, for controlling the discharge of molten material from a spout of a vessel, said slide gate nozzle comprising:

a refractory bottom plate to be positioned stationarily with a discharge opening thereof aligned with an opening of the spout;

a refractory slide valve plate mounted for sliding movement relative to said bottom plate such that a discharge opening of said slide valve plate may be brought into and out of alignment with said discharge opening of said bottom plate; and at least one refractory shut-off plate positioned sealingly between said bottom plate and said slide valve plate and mounted to be rigidly attached selectively either to said bottom plate with a discharge opening of said at least one shut-off plate aligned with said discharge opening of said bottom plate, whereat said slide valve plate is slidable relative to said at least one shut-off plate, or to said slide valve plate with said discharge opening of said at least one shut-off plate aligned with said discharge opening of said slide valve plate, whereat said at least one shut-off plate is slidable with said slide valve plate relative to said bottom plate.

2. A slide gate nozzle as claimed in claim 1, comprising a plurality of shut-off plates mounted between said bottom plate and said slide valve plate such that each said shut-off valve plate selectively is rigidly attachable either to said bottom plate or to said slide valve plate.

3. A slide gate nozzle as claimed in claim 1, further comprising a coupling mechanism operably mounted for selectively attaching said at least one shut-off plate either to said bottom plate or to said slide valve plate.

4. A slide gate nozzle as claimed in claim 3, comprising a plurality of shut-off plates, and said coupling mechanism is operable to selectively attach each said shut-off plate to said bottom plate or to said slide valve plate.

5. A slide gate nozzle as claimed in claim 4, wherein said coupling mechanism is operable first to attach all of said shut-off plates to said bottom plate, then to attach to said slide valve plate a said shut-off plate closest to said slide valve plate and to attach remaining said shut-off plates to said bottom plate, and then sequentially to attach one more said shut-off plate to said slide valve plate and one less said shut-off plate to said bottom plate.

6. A slide gate nozzle as claimed in claim 4, further comprising a housing frame to be fixedly mounted on the vessel with said bottom plate fixedly mounted within said housing frame, and a slide frame mounted for sliding movement in a first direction relative to said housing frame and supporting said slide valve plate.

7. A slide gate nozzle as claimed in claim 6, wherein said coupling mechanism comprises a first connection member slidable in said first direction with said slide frame and mounted therein for relative movement with respect thereto in a second direction perpendicular to said first direction, a second connection member mounted in said housing frame for sliding movement relative thereto in said second direction, said first and second connection members having respective connection elements to engage, depending on relative positions thereof in said second direction, corresponding of said slide valve plate and/or said shut-off plates aligned therewith in said first direction, said first and second connection members being coupled for movement together in said second direction but not in said first direction, and an adjusting device coupled to said second connection member for selectively adjusting the position thereof in said second direction with respect to said housing frame and thereby engaging said connection element of said second connection member with a respective said shut-off plate, and thus adjusting the position in said second direction of said first connection member relative to said slide frame and thereby engaging said connection element of said first connection member with a respective said shut-off plate.

8. A slide gate nozzle as claimed in claim 7, wherein said adjusting device comprises at least one lever pivotable about an axis between plural pivot positions.

9. A slide gate nozzle as claimed in claim 8, comprising two said levers, one each mounted on a respective side of said housing frame.

10. A slide gate nozzle as claimed in claim 8, further comprising means for retaining said at least one lever at respective said pivot positions thereof.

11. A slide gate nozzle as claimed in claim 7, wherein each said shut-off plate is mounted in a respective support frame having a groove or projection, and said connection elements of said first and second connection members comprise respective projections or grooves slidable into or over, respectively, said groove or projection of an aligned said shut-off plate.

12. A slide gate nozzle as claimed in claim 6, wherein said coupling mechanism comprises a first coupling assembly for coupling and uncoupling said shut-off plates to said slide valve plate and a second coupling assembly for coupling and uncoupling said shut-off plates to said bottom plate.

13. A slide gate nozzle as claimed in claim 12, wherein said first coupling assembly is mounted on said slide frame and said second coupling assembly is mounted on said housing frame.

14. A slide gate nozzle as claimed in claim 13, wherein each of said first and second coupling assemblies comprises at least one control pin mounted on said slide frame or on said housing frame for rotation about an axis extending in a second direction transverse to said first direction, each said shut-off plate is mounted in a respective support frame, and a plurality of coupling structures associated with said at least one control pin for, depending on a relative rotary position of said at least one control pin, coupling with and uncoupling from said support frame of each of said shut-off plates.

15. A slide gate nozzle as claimed in claim 14, wherein each of said coupling assemblies comprises a pair of control pins rotatable in opposite directions about respective parallel axes.

16. A slide gate nozzle as claimed in claim 15, wherein rotation of said pair of control pins is synchronous.

17. A slide gate nozzle as claimed in claim 15, wherein said coupling structures are spaced axially along said control pins and align in said first direction with respective said support frames.

18. A slide gate nozzle as claimed in claim 17, wherein each said support frame has a projection extending in said first direction to be between said pair of control pins, and said projection has on opposite sides thereof facing said control pins respective concave recesses.

19. A slide gate nozzle as claimed in claim 18, wherein said axially spaced coupling structures comprise, on each said control pin, different combinations of circumferentially extending configurations including a first configuration dimensioned to fit within said concave recess of said projection of the respective said support frame, whereat said support frame projection is grasped between said first configurations of said two control pins and said respective support frame thereby is coupled thereto, and at least one second configuration dimensioned to not extend into said concave recess of said projection of said respective support frame, whereat said support frame projection is relatively freely movable between said second configurations of said two control pins and said respective support frame thereby is uncoupled therefrom.

20. A slide gate nozzle as claimed in claim 19, wherein said first configuration is circumferentially cylindrical, and said second configuration comprises a circumferentially cut-away portion.

21. A slide gate nozzle as claimed in claim 20, wherein the circumference of each said control pin includes a whole number of equal angularly offset portions, the circumferential length of said first configuration equals a whole number of said portions, and the circumferential extent of each said second configuration equals one said portion.

22. A slide gate nozzle as claimed in claim 21, wherein said portions are angularly offset by 90°.

23. A slide gate nozzle as claimed in claim 21, wherein each said second configuration comprises a recess formed in the respective said portion of said circumference.

24. A slide gate nozzle as claimed in claim 23, wherein said recess is defined by an axially extending planar surface forming a chord of said circumference as viewed axially in said control pin.

25. A slide gate nozzle as claimed in claim 17, wherein each said axially spaced coupling structure comprises at least one lever extending between said pair of control pins, and said control pins include cams acting on said at least one lever to, depending on positions of rotation of said control pins, pivot said lever into or out of holding engagement with a respective said support frame.

26. A slide gate nozzle as claimed in claim 25, wherein each said coupling structure comprises a pair of levers mounted to pivot in opposite directions away from each other and toward each other.

27. A slide gate nozzle as claimed in claim 26, wherein said respective support frame has therein a recessed opening, and said levers have hooked ends insertable into said opening when said levers are toward each other and movable into hooking engagement internally of said opening when said levers are moved away from each other.

28. A slide gate nozzle as claimed in claim 13, wherein each said coupling assembly comprises a sleeve mounted on said slide frame or on said housing frame, and a driving pin mounted in said sleeve for movement axially relative thereto in a second direction transverse to said first direction between selected positions coupled with or uncoupled from selected of said shut-off plates.

29. A slide gate nozzle as claimed in claim 28, wherein each said shut-off plate is mounted in a respective support frame to be coupled with or to be uncoupled from said driving pin as a function of axial movement thereof.

30. A slide gate nozzle as claimed in claim 29, wherein each said support frame has therethrough a bore, and said axial movement of said driving pin moves said driving pin into said bore of a respective said support frame to couple thereto or moves said driving pin from said bore of a respective said support frame to uncouple therefrom.

31. A slide gate nozzle as claimed in claim 29, wherein said driving pin has a main thickness portion and a reduced thickness portion, each said support frame has therein an opening having a size corresponding to said main thickness portion and a reduced size slot joining said opening and having a size corresponding to said reduced thickness portion, and said axial movement of said driving pin couples to a respective said support frame when said main thickness portion of said driving pin is extended into said opening of said respective support frame, and uncouples from said respective support frame when said reduced thickness portion of said driving pin is extended into said opening of said respective support frame such that relative movement between said driving pin and said respective support frame in said first direction is enabled by said reduced thickness portion of said driving pin fitting through said reduced size slot.

32. A slide gate nozzle as claimed in claim 13, Wherein said first and second coupling assemblies are spaced in said first direction on opposite sides of said bottom plate.

33. A slide gate nozzle as claimed in claim 13, wherein said first and second coupling assemblies both are located at positions on a side of said bottom plate facing a drive of said slide frame.

34. A refractory plate assembly for use in a slide gate nozzle to be employed for controlling the discharge of molten material from a spout of a vessel, said refractory plate assembly comprising:

a refractory bottom plate to be positioned stationarily with a discharge opening thereof aligned with an opening of the spout;

a refractory slide valve plate to be mounted for sliding movement relative to said bottom plate such that a discharge opening of said slide valve plate may be brought into and out of alignment with said discharge opening of said bottom plate; and at least one refractory shut-off plate positioned sealingly between said bottom plate and said slide valve plate and selectively rigidly attachable either to said bottom plate with a discharge opening of said at least one shut-off plate aligned with said discharge opening of said bottom plate, whereat said slide valve plate is slidable relative to said at least one shut-off plate, or to said slide valve plate with said discharge opening of said at least one shut-off plate aligned with said discharge opening of said slide valve plate, whereat said at least one shut-off plate is slidable with said slide valve plate relative to said bottom plate.

35. A refractory plate assembly as claimed in claim 34, comprising a plurality of shut-off plates positioned between said bottom plate and said slide valve plate.

* * * * *